US007422344B2

(12) United States Patent
Wu et al.

(10) Patent No.: US 7,422,344 B2
(45) Date of Patent: Sep. 9, 2008

(54) FULL COLOR FLASHLIGHT WITH HIGH POWER LED

(75) Inventors: Ting-Feng Wu, Kaohsiung (TW); Jun-Hong Lin, Pingtung (TW)

(73) Assignees: Anteya Technology Corporation, Kaohsiung Hsien (TW); Sean & Stephen Corporation, Taipei (TW)

( * ) Notice: Subject to any disclaimer, the term of this patent is extended or adjusted under 35 U.S.C. 154(b) by 0 days.

(21) Appl. No.: 11/344,254

(22) Filed: Feb. 1, 2006

(65) Prior Publication Data

US 2007/0177378 A1 Aug. 2, 2007

(51) Int. Cl.
*F21L 4/02* (2006.01)

(52) U.S. Cl. ..... 362/184; 362/194; 362/202; 362/205; 362/227; 362/800

(58) Field of Classification Search ..... 362/184, 362/194, 199, 202, 205, 206, 208, 227, 230, 362/231
See application file for complete search history.

(56) References Cited

U.S. PATENT DOCUMENTS

| | | | | |
|---|---|---|---|---|
| 6,357,893 | B1 * | 3/2002 | Belliveau | 362/285 |
| 6,527,419 | B1 * | 3/2003 | Galli | 362/308 |
| 6,541,800 | B2 * | 4/2003 | Barnett et al. | 257/98 |
| 6,577,073 | B2 * | 6/2003 | Shimizu et al. | 315/246 |
| 6,614,103 | B1 * | 9/2003 | Durocher et al. | 257/678 |
| 6,722,771 | B1 * | 4/2004 | Stephens | 362/184 |
| 6,922,018 | B2 * | 7/2005 | Zhang et al. | 315/56 |
| 6,942,365 | B2 * | 9/2005 | Galli | 362/294 |
| 6,957,905 | B1 * | 10/2005 | Pritchard et al. | 362/554 |
| 7,083,298 | B2 * | 8/2006 | Pritchard et al. | 362/184 |
| 7,186,000 | B2 * | 3/2007 | Lebens et al. | 362/184 |
| 7,204,607 | B2 * | 4/2007 | Yano et al. | 362/231 |
| 7,220,016 | B2 * | 5/2007 | Matthews et al. | 362/205 |
| 7,261,456 | B2 * | 8/2007 | Liu | 362/577 |
| 2005/0052885 | A1 * | 3/2005 | Wu | 362/565 |
| 2005/0122714 | A1 * | 6/2005 | Matthews et al. | 362/206 |
| 2007/0103900 | A1 * | 5/2007 | Lee et al. | 362/231 |
| 2007/0109775 | A1 * | 5/2007 | Chen | 362/187 |

* cited by examiner

*Primary Examiner*—Jong-Suk (James) Lee
*Assistant Examiner*—Leah S Lovell
(74) *Attorney, Agent, or Firm*—Rosenberg, Klein & Lee

(57) ABSTRACT

The present invention discloses a full color flashlight with high power LEDs. The flashlight is primarily composed of a full color LED module having LED chip set of different wavelengths, a control-circuit module, a function switch, batteries, and a barrel body. By controlling the LED chip set of different wavelengths through the control-circuit module, light beams of various colors can be emitted and uniformly mixed. The flashlight further comprises a function switch for changing the color of light and/or switching operation modes between a fast flash mode, a slow flash mode, a brightness control mode and un-lighting. Accordingly, the full color flashlight can be employed in different environments, for example, yellow or light blue light can be used at night to prevent the eyes from dazzling, and red flash can be as warning signal during traffic events; in conclusion, the present invention can be elaborate in the day-to-day life.

3 Claims, 8 Drawing Sheets

FULL COLOR FLASHLIGHT WITH HIGH POWER LED

BACKGROUND OF THE INVENTION

1. Field of the Invention

The present invention relates to a full color flashlight with high power LEDs, which particularly comprises a control-circuit module and a full color LED module having LED chip sets of different wavelengths, and therefore can perform light of various colors. The LED flashlight of the present invention also provides a function switch for changing color and/or brightness of light, or switching flash modes, so as to be suitable for different situations.

2. Related Prior Arts

The conventional LED flashlights can only emit light of a single color, for example, white, red, blue, green or yellow, therefore, consumers have to purchase more than one flashlights to deal with different situations and purposes. It waste money and is inconvenient for the user during operation.

Better than the monochromatic flashlights, dual color LED flashlights may perform two colors, for example, white and green, or white and blue. However, it is still not versatile enough for practical use.

To solve such problems, tricolor LED flashlights was developed, which typically comprise red and green and blue (RGB) three colors. Unfortunately, the conventional tricolor flashlights could merely perform three colors individually, but cannot generate other uniform colors by mixing the light beams; therefore, conventional tricolor flashlights still has two disadvantages as follow:

Disadvantage 1: Practical white light is not available. FIG. 8 shows a traditional tricolor LED flashlight which is composed of six red LEDs (81), six green LEDs (82) and six blue LEDs (83), so that could perform three colors individually. Since such flashlight lacks a regulating mechanism for uniformly mixing light, while it wants to perform white light, all LEDs have to be lit simultaneously, and therefore spots of red, green and blue light will be apparently observed, not the typical white light we want.

Disadvantages 2: In addition to white light, uniform light of other colors also could not be achieved without proper regulating mechanism, for example, pink, purple, or amber. Therefore, the mixed color is still displayed as spots of red, green and blue light, not the typical pink, purple, or amber color we want.

Hence, the conventional tricolor LED flashlight can normally perform three colors only. Other colors will not be available as the problem of mixing light is not effectively.

The present invention thus provides a full color flashlight, whereby the user can use it in different situations and purposes without carrying other flashlights. Moreover, the full color LED flashlight not only can be operated in different modes to perform various colors, but also could be operated such as fast or slow flash. Therefore, consumers only buy one flashlight for adapting any purpose. In addition, the full color flashlight of the present invention also performs superior effect in mixing light. By uniformly mixing the light beams, white light and other versatile colors, such as pink, cyanic, orange, purple or amber, etc., that can be achieved as well mixed.

SUMMARY OF THE INVENTION

The objective of full color flashlight with high power LEDs, that was invented for solving problems which mentioned before.

In the present invention, two or more high power LED bare chips of different wavelengths are preferably used, for example, high power three color LED chips of red and green and blue or yellow and green and blue. Compared with the traditional tricolor LED flashlights, the present invention has three merits as follows:

1. The size is reduced by using the high power LED bare chips. High power LED bare chips are used of this invention. Compared with traditional LED chips, its power is higher than traditional one. For example, 1 watt of high power LED chips are used in present invention, but the traditional chips only contain 0.05 watt, therefore, the present inventions only need one high power LED chip that can illuminate as twenty traditional LED chips, and thus the size of the present invention is effectively reduced.
2. LED chips are mounted on the same base. Because of the size of high power LED chips are small, so they could be mounted on the same base and also arranged very closely. Therefore, while emitting lights simultaneously, the result of these small LED chips are looked like a single light source. By such arrangement, people will see the mixed light performing only in one color, and thus purer white light or light of other colors can be achieved.
3. Adding light mixer. Additional compositions such as the photodiffuser as light mixer, which can be added in the transparent glue in front of the LED bare chips for protecting the LED bare chips. The photodiffuser can diffuse the light beams emitted from the red, green, and blue (RGB) or yellow, green and blue (YGB) LED chips, whereby the light beams will travel randomly in arbitrary directions and be mixed white light or other color lights uniformly and cannot be distinguished by people.

According to the present invention, that could be emitted various colors, but also uniform light of different colors, for example, white light, purple light, pink light, orange light, cyanic light, amber light, etc. By operating the function switch, the user can conveniently change color and optically switch different modes such as fast or slow flash. Therefore, it is suitable for any situations, for example, yellow or light blue light can be used at night to prevent the eyes from dazzling, and red flash can be a warning signal during traffic events, so this invention can be elaborate in the life.

DETAILED DESCRIPTION OF THE PREFERRED EMBODIMENTS

Figure 1:
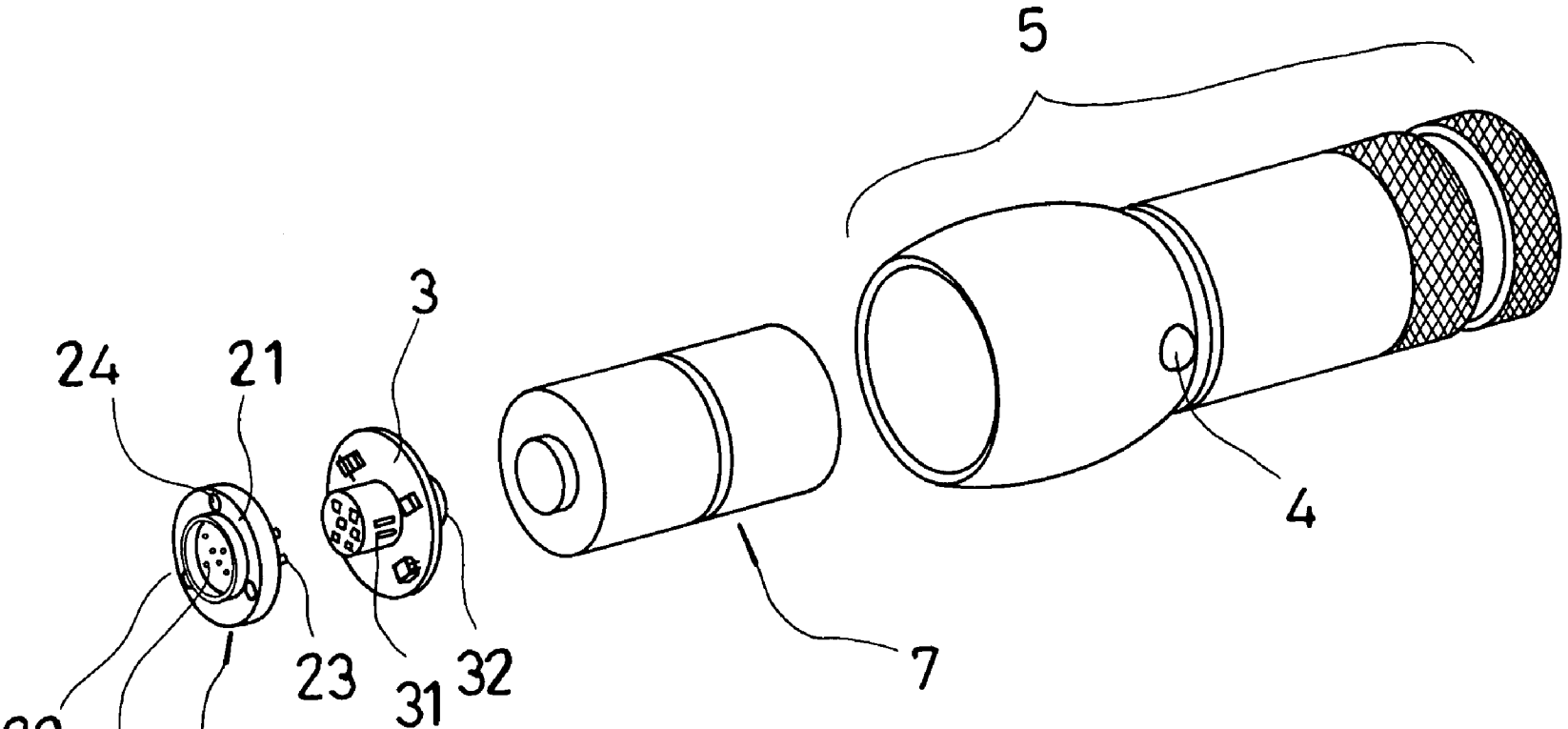
FIG. 1 shows the disassembled flashlight of the first embodiment in accordance with the present invention.

FIG. 1 shows a disassembled flashlight of the first embodiment in accordance with the present invention, in which a frill color LED module (2), a control-circuit module (3), a function switch (4), a barrel body (5) and batteries (7) are included. The full color LED module (2), the control-circuit module (3) and the batteries (7) are all housed in the barrel body (5).

As shown in FIG. 1, the full color LED module (2) comprises at least two LED chips (20) emitting light beams respectively having different wavelengths, for example, red, green and blue (RGB) high power LED chips or yellow, green and blue (YGB) high power LED chips. The LED chips (20) are mounted on a DIP base (21), surrounded by a circular wall formed on the DIP base (21) and are further covered by a transparent glue (22). Positive and negative electrodes of the LED chips (20) are electrically connected respectively to metallic pins (23). In this embodiment, the metallic pins (23) can be properly inserted into corresponding holes within an electrical connector (31) of the control-circuit module (3).

Figure 2:
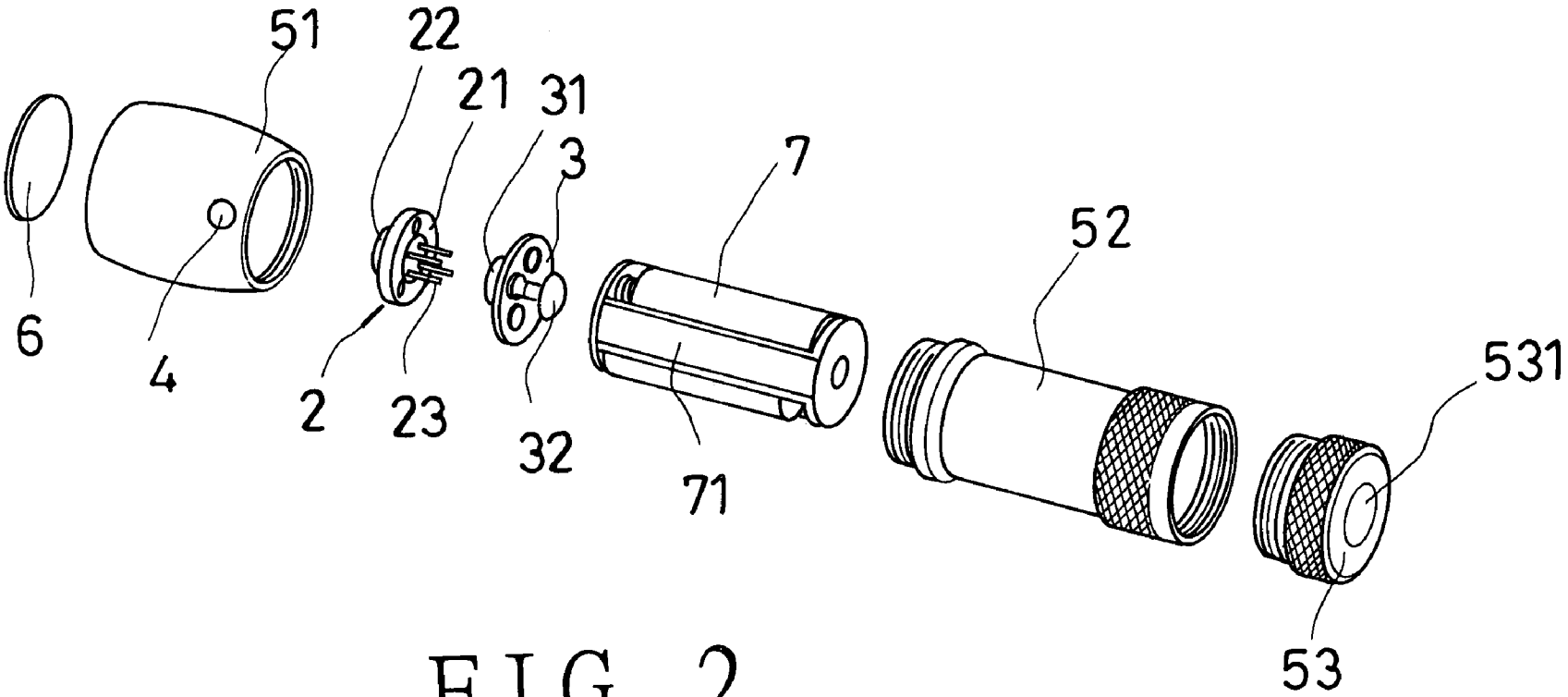
FIG. 2 shows the disassembled flashlight of the second embodiment in accordance with the present invention.
Figure 3:
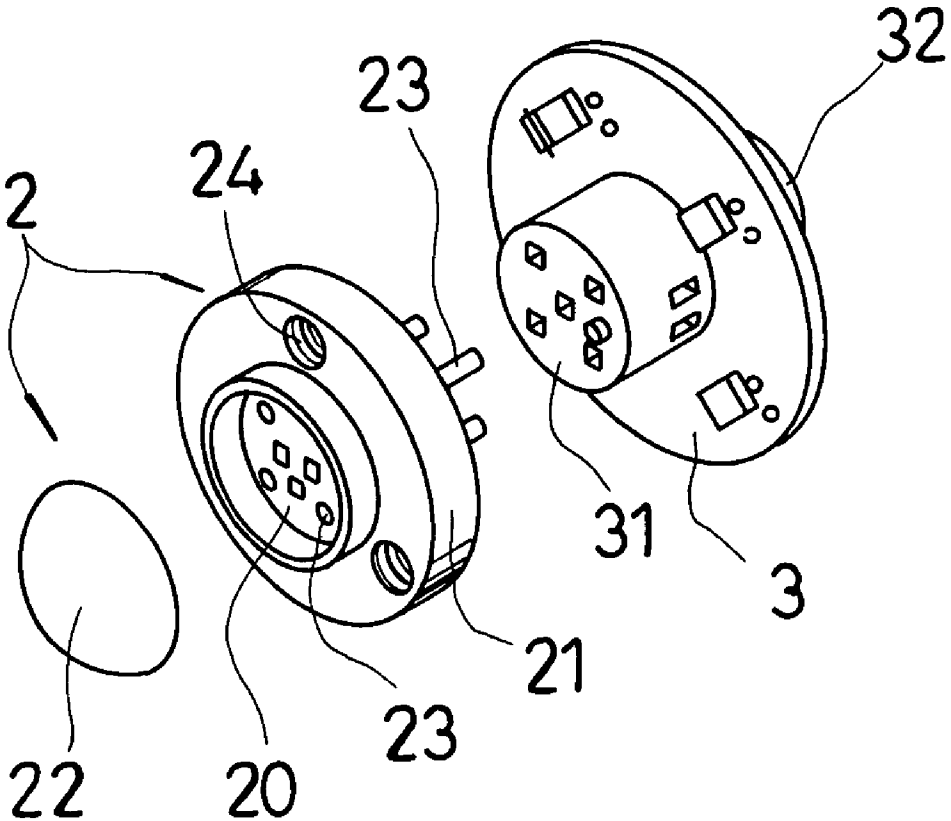
FIG. 3 indicates the connection between the full color LED module and the control-circuit module in detail.

As shown in FIGS. 1~3, the control-circuit module (3) also provides an electrode terminal (32) typically connected to the positive electrode of one battery (7), and a contact is connected to the negative electrode of one battery (7) though the barrel body (5). Through the above circuit, necessary voltage can be supplied to the LED chips and light them. While such typical electrical connection is exemplified in the preferred embodiments, any other circuit suitable for the flashlight can be applied to the present invention without specific limitation.

In general, the function switch (4) is also electrically connected to the control-circuit module (3) to transmit signals thereto. By switching the function switch (4), the control-circuit module (3) will determine which mode is selected and how to light the LED chips (20) of the full color LED module (2) accordingly. As a result, a full color flashlight with high power LEDs and selective operation modes is achieved.

As shown in FIG, 2, the barrel body (5) can be divided into a barrel head (51), a barrel main body (52) and a barrel tail cap (53), so that the barrel body can be easily separated and assembled. In addition, a reflector (not shown in figures) is disposed in the barrel head (51) to concentrate or focus the light beams emitted from the full color LED module (2). Furthermore, a plate lens (6) is mounted on a front opening of the barrel head (51) to protect elements within the barrel head (51) from impact dusts and moisture.

In FIG. 2, a power switch (531) is disposed behind the barrel tail cap (53). The power switch can be designed as any proper forms, for example, a push button or a rotary switch. Additionally, the batteries (7) can be pre-installed in a battery holder (71) which is then inserted into the barrel body (5).

FIG. 3 further indicates connection between the full color LED module (2) and the control-circuit module (3) in detail, in which the DIP (Dual In-line Package) technology is applied. The full color LED module (2) comprises the LED chips (20), the DIP base (21), the transparent glue (22), the metallic pin (23), threaded hole (24), the electrical connector (31) and the electrode terminal (32). The DIP base (21) has a front, a rear and a circular wall. The circular wall is formed on the front of the DIP base (21). The LED chips (20) are mounted on the DIP base (21) are covered by the transparent glue (22), are surrounded by the circular wall of the DIP base (21), and have electrodes connected to the metallic pins (23). The metallic pins (23) are further extended from behind the DIP base (21) so as to couple with the electrical connector (31) that is on the front side of the control-circuit module (3). The electrode terminal (32) is on the rear side of the control-circuit module (3) for contacting with the battery. The LED chips (20) are preferably composed of two or more chips of different wavelengths, for example, using red, green and blue (RGB) high power LED chips, or the yellow, green and blue (YGB) high power LED chips. Because the individual chips are small enough to be densely mounted on the DIP base (21), the LED chips (20) can perform as a single light source. That is, the light beams emitted from different LED chips are well mixed and can not be distinguished by people. Thus light of purer white or other colors are achieved.

In addition, a photodiffuser can be provided in the transparent glue (22), so that the light beams emitted from the LED chips (20) of different colors can be diffused and travel randomly in arbitrary directions. Thereby the light beams can be mixed more uniformly and will be more practical for use. The photodiffuser can be any one or more suitable material, for example, silicone resin, $Al_2O_3$, MgO, ZnO, $TiO_2$, MgO and BaO.

Figure 4:
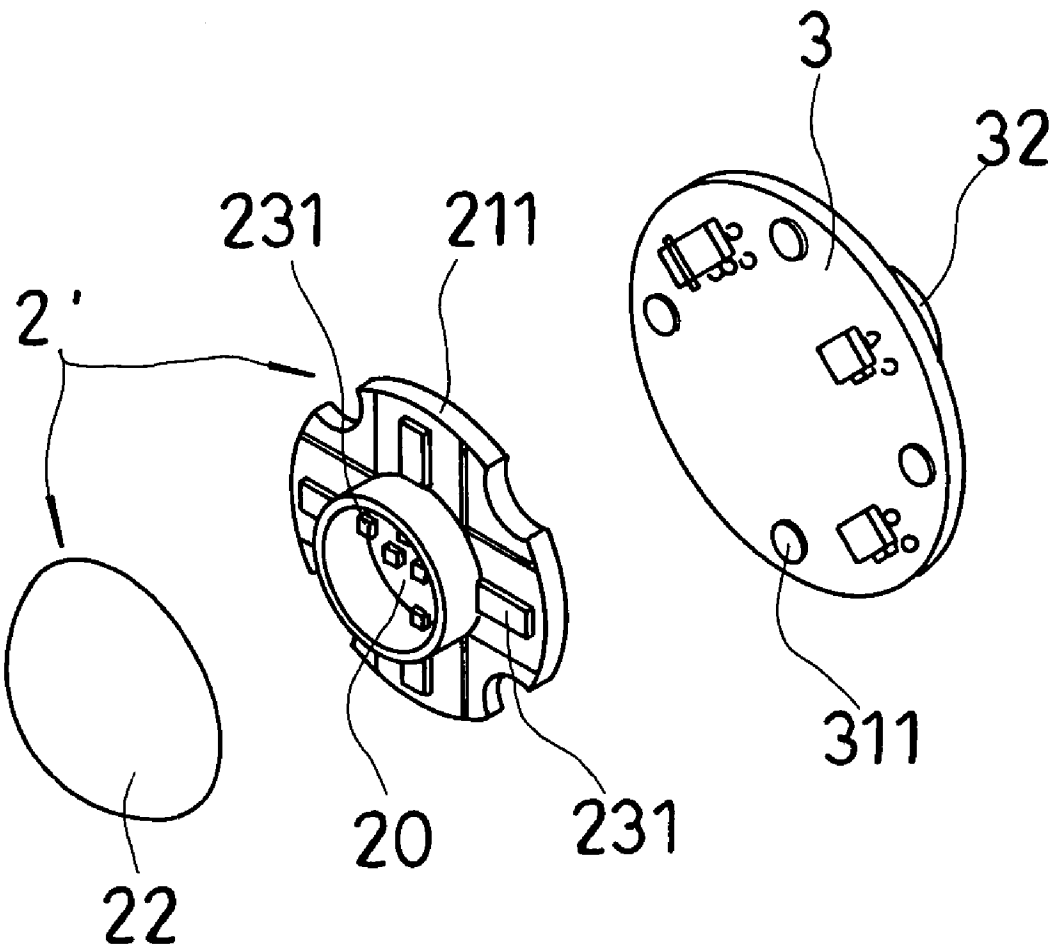
FIG. 4 shows the alternative connection between the full color LED module and the control-circuit module.

FIG. 4 shows an alternative connection between the full color LED module (2) and the control-circuit module (3), not only DIP (Dual In-line Package) technology is applied (show in the FIG. 3); in which SMD (Surface Mount Device) also can be applied.

The SMD base (211) comprises several metallic pins (231) for electrically connecting to the LED chips (20). The metallic pins (231) are also connected to the electrical connector (311) of the control-circuit module (3). The transparent glue (22) is on the LED chips (20) to develop the full color LED module (2').

Figure 5:
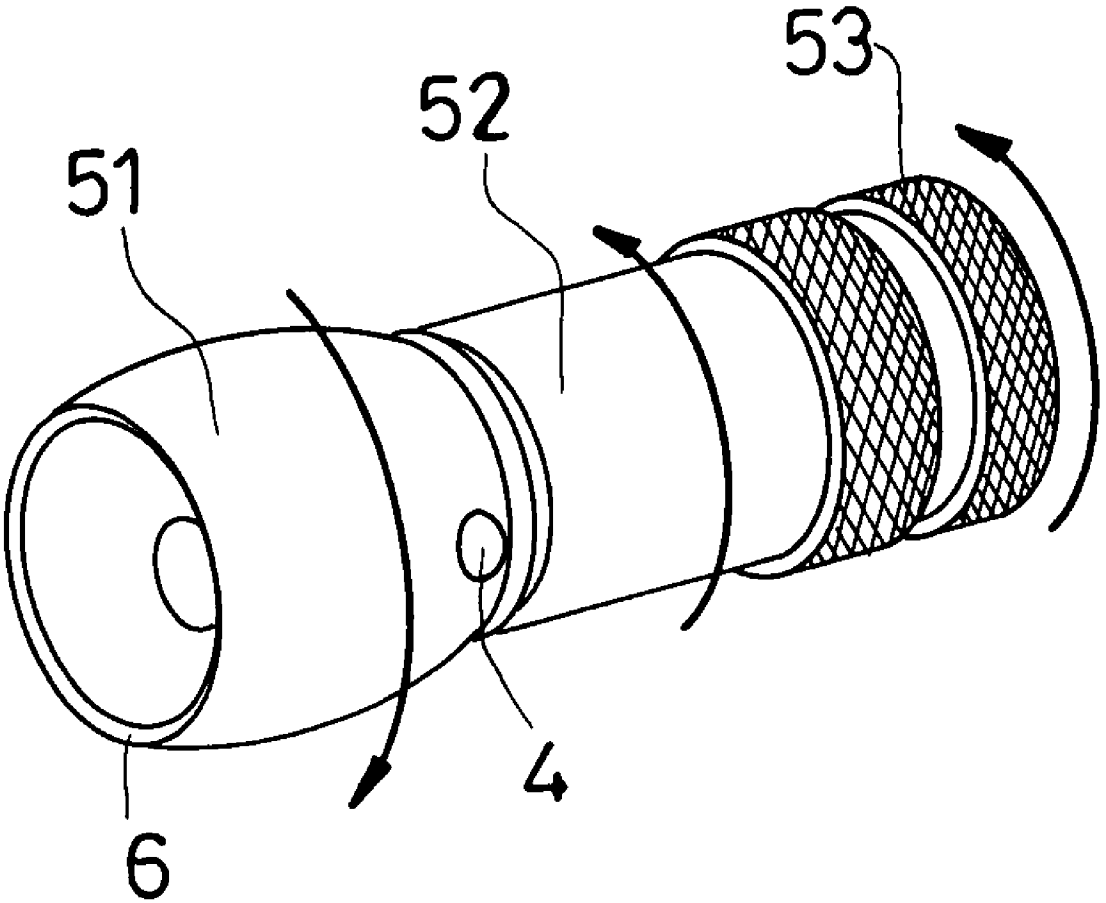
FIG. 5 shows the rotational switch.

The power switch of the present invention is not restricted to be disposed behind the barrel tail cap (53) as shown in FIG. 2, and can be also arranged at any positions where the user can conveniently operate. The power switch can be even associated with the function switch (4), and designed as other types in addition to a push button. FIG. 5 shows a rotational switch, in which the barrel head (51), the barrel main body (52) or the barrel tail cap (53) can be rotated to a specific position to start the circuit. When not used, the flashlight can be turned off by inversely rotating the barrel head (51), the barrel main body (52) or the barrel tail cap (53).

Figure 6:
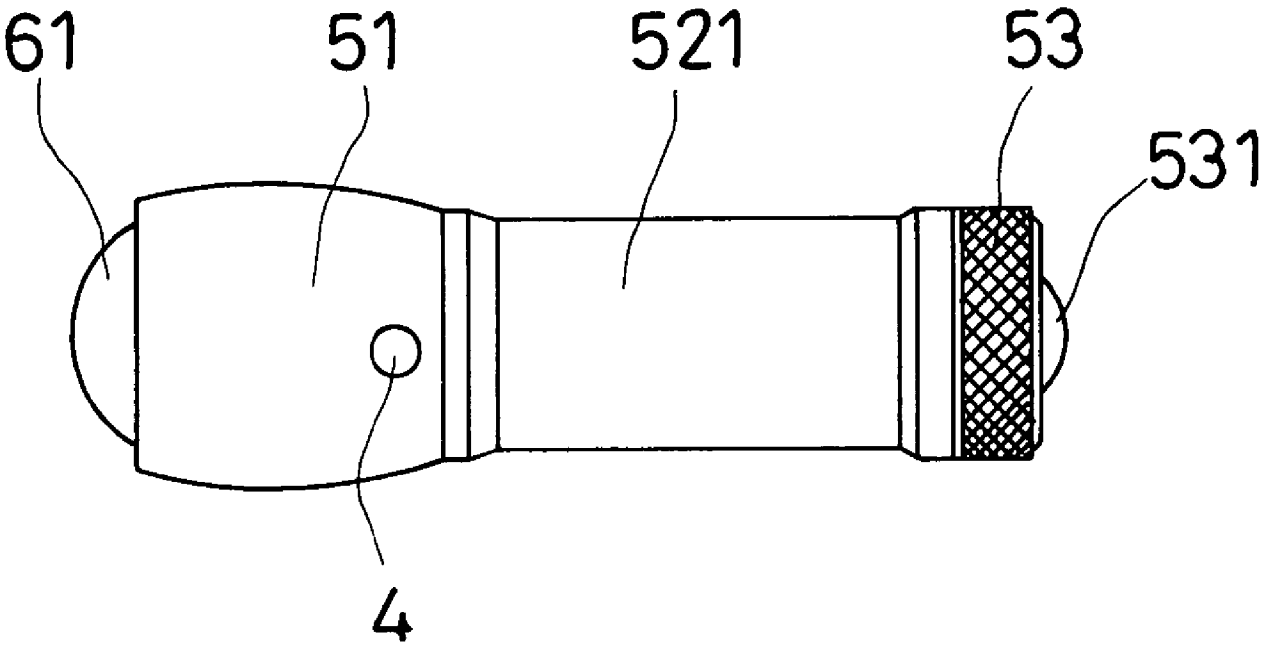
FIG. 6 shows the convex lens instead of the plate lens of FIGS. 2~4.
Figure 7:
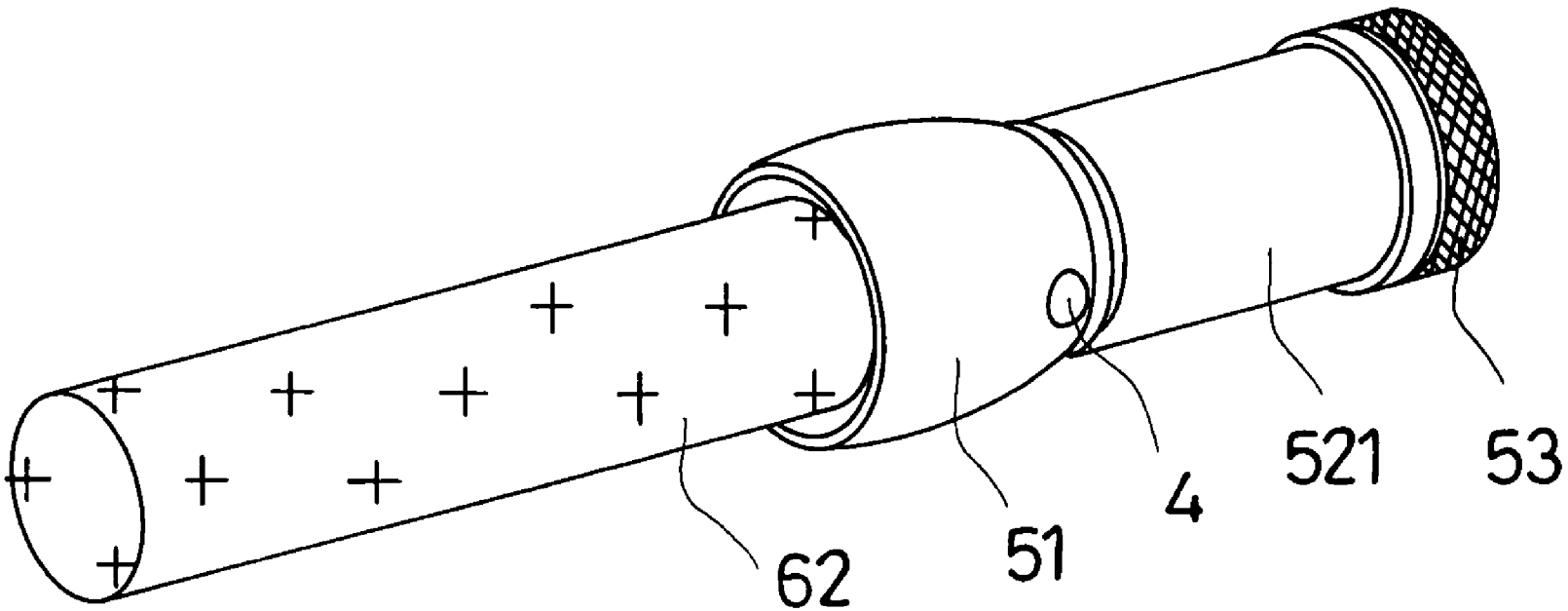
FIG. 7 shows the transparent rod instead of the plate lens of FIGS. 2~4.
Figure 8:
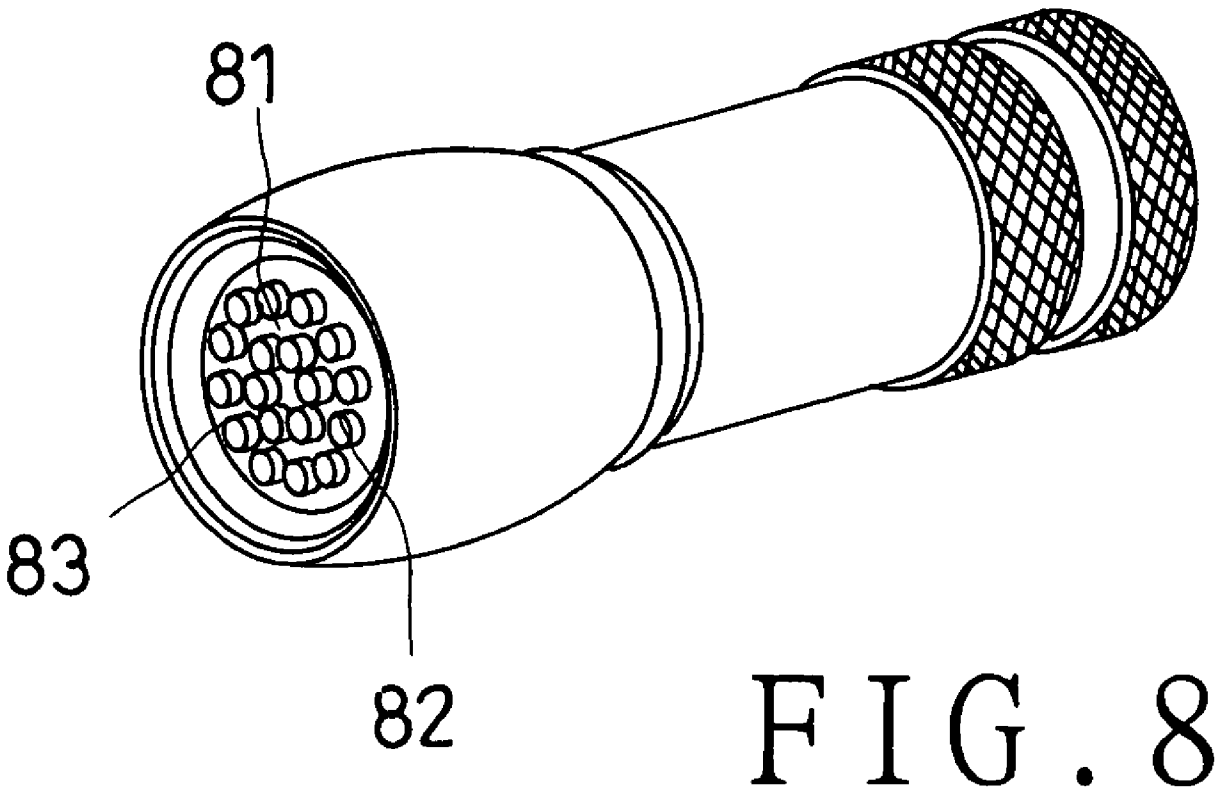
FIG. 8 (PRIOR ART)
FIG. 8 shows the typical tricolor LED flashlight.

FIGS. 6 and 7 show more types of the flashlights, in which the flat plate lens (6) can be replaced with a convex lens (61), a concave lens (not shown in figures), a transparent rod (62), a hollow transparent tube (not shown in figures), etc. These may allow the user to apply the flashlight in different situations. For example, the concave lens facilitating illumination farther that is suitable for using in the night or mountains, and the transparent rod (62) can be operated flash mode of red light that can serve as a temporary traffic signal baton. All examples as mentioned that can be operated in the day-to-day life by using full color flashlight. The customer can optically select a full color flashlight with proper functions, or change different type of barrel main body (521) instead of the barrel main body (52).

One significant feature of the present invention is the function switch (4), which is disposed behind the barrel body (5) and electrically connected to the control-circuit module (3). By operating the function switch (4), the user may change colors of light, or make the light fast or slow flash, or unilluminated. Preferred operation modes of the function switch (4) in the form of one button are as follows:

1. Change colors of light
   Press the button once to change a light color.
2. Flash mode
   Continuously press the button for 2 seconds to enter the fast flash mode;
   continuously press the button for another 2 seconds to enter the slow flash mode; and
   continuously press the button for 2 seconds again to leave the flash mode.
3. Sleeping mode
   Continuously press the button for 5 seconds to enter the sleeping mode, i.e., unillumination; and press the button again to return to the previous lighting state.

4. After flashlight stating in the sleeping mood, the pervious lighting state will be recorded automatically, so while flashlight is operated again, the recorded color of light will be illuminated.

Also, the function switch (4) may comprise one or more operation elements, and can be disposed on any suitable position where the user can conveniently operate it. For the function switch (4) with two buttons (for example, button A and button B), preferred operation modes are as follows:

1. Change colors
   Press the button A once to change a light color.
2. Flash mode
   Press the button two seconds serially to enter the fast flash mode;
   press the button B once again to enter the slow flash mode; and
   press the button once again to leave the flash mode and back to normal mode.
3. Sleeping mode
   Continuously press the button A or B for 3 seconds to enter the sleeping mode as unillumination; and press the button once again to return to the previous lighting state.
4. After flashlight state in the sleeping mood, the pervious lighting state will be recorded automatically, so while flashlight is operated again, the recorded color of light will be illuminated.

In the present invention, the batteries (7) are not limited to the dry battery, and can be a lithium cell, an alkaline cell, a rechargeable cell, a mercury cell, etc. All of the batteries that we use in any electric equipment are suitable for full color flashlight with high power LED of this invention.

In the present invention, the full color flashlight not only performs single color, dual color, tricolor or seven colors, buy also can perform light of various colors by controlling current flowing through each of the LED chips. For example, the light beams emitted from the red, green and blue (RGB) LED chip sets can be mixed in specific ratios to perform colors as follows:

1. 70% R+90% G+100% B=white
2. 100% R+0% G+70% B=pink
3. 100% R+80% G+0% B=yellow
4. 60% R+40% G+100% B=purple Accordingly, colors of the light can be arbitrarily varied by changing the current flowing through the RGB LED chip sets. For example, if the current of the RGB LED chips can be varied with a scale of 1~100, then theoretically, one million (100×100×100) different colors can be performed. Practically, only a few colors are enough. That is, colors performed by the full color flashlight of the present invention are no more limited but can be selected from these all colors, therefore, that is a reason to call the invention as full color flashlight.

According to the foregoing, the present invention provides a full color LED flashlight using the high power LED bare chips of different wavelengths. Since these LED bare chips are very small sized and arranged closely, and thus the LED bare chips can exhibit uniform light of purer color similar to a single light source. The photodiffuser can be further added in the transparent glue before the LED bare chips, so that the light beams emitted from the LED chips will travel randomly in arbitrary directions and be mixed well.

The LED flashlight of the present invention also comprises the function switch for changing colors of the light, and/or switching the operation modes such as the fast/slow flash mode, and the un-lighting mode. Since the full color flashlight of the present invention can perform various colors, it is suitable for different situations, for example, the yellow or light blue color is suitable for nighttime to prevent eyes from dazzling, and the red flash may serve as a warning signal during traffic accidents.

According to pervious description, the present invention possesses with commercial benefit, creativity and improvement which are required for applying for a patent. Therefore, it is followed by the law to provide all necessary information.

What is claimed is:

1. A full color flashlight with high power LEDs comprising:

a barrel body having a front opening;

a full color LED module housed in the barrel body, facing the front opening of the barrel body and comprising:

a dual in-line package base having a front;

a rear; and a circular wall formed on the front of the base;

at least two LED chips mounted on the front of the base, surrounded by the circular wall of the base and emitting light beams of different wavelengths;

a transparent glue received by and protruding from the circular wall to cover the LED chips and having a photodiffuser to mix the light beams emitted from the LED chips and form a single light source; and metallic pins mounted on the rear of the dual in-line package base and electrically connected to the LED chips;

a control-circuit module housed in the barrel body, electrically connected to the full color LED module and having a front;

a rear;

an electrode terminal being on the rear of the control-circuit module;

a contact being on the rear of the control-circuit; and an electrical connector being disposed on the front of the control-circuit module to allow the metallic pins to plug into the electrical connector;

a function switch electrically connected to and communicating with the control-circuit module; and a battery housed in the barrel body and having a positive electrode connected to the electrode terminal of the control-circuit module; and a negative electrode connected to the contact of the control-circuit module.

2. The full color flashlight with high power LEDs as claimed in claim 1 further comprising a convex lens mounted on the front opening of the barrel body.

3. The full color flashlight with high power LEDs as claimed in claim 1 further comprising a transparent rod mounted on the front opening of the barrel body.

* * * * *